US006357373B1

(12) United States Patent
Hagner et al.

(10) Patent No.: US 6,357,373 B1
(45) Date of Patent: Mar. 19, 2002

(54) REBUILT DOUBLE HULL VESSEL AND METHOD OF REBUILDING A SINGLE HULL VESSEL INTO A DOUBLE HULL VESSEL

(75) Inventors: Thomas Hagner, Swarthmore; Steven Pagan, Limerick, both of PA (US); George Mara, Middletown, NJ (US); Matthew D. Jones, Sugar Land, TX (US)

(73) Assignee: Maritrans Inc., Tampa, FL (US)

( * ) Notice: Subject to any disclaimer, the term of this patent is extended or adjusted under 35 U.S.C. 154(b) by 0 days.

(21) Appl. No.: 09/689,420

(22) Filed: Oct. 12, 2000

Related U.S. Application Data

(63) Continuation of application No. 09/289,031, filed on Apr. 9, 1999, now Pat. No. 6,170,420.
(60) Provisional application No. 60/112,394, filed on Dec. 15, 1998.

(51) Int. Cl.[7] ..... B63B 3/62
(52) U.S. Cl. ..... 114/65 R; 114/74 A
(58) Field of Search ..... 114/74 A, 65 R

(56) References Cited

U.S. PATENT DOCUMENTS

| | | | | |
|---|---|---|---|---|
| 3,399,645 A | | 9/1968 | Dahan | 114/74 A |
| 3,574,921 A | | 4/1971 | Fiegel et al. | 29/457 |
| 3,590,466 A | | 7/1971 | Moshammer et al. | 29/471.3 |
| 3,742,889 A | | 7/1973 | Weise et al. | 114/65 R |
| 3,797,099 A | | 3/1974 | Myers | 29/471.3 |
| 3,811,593 A | | 5/1974 | Bridges et al. | 220/9 LG |
| 4,230,061 A | * | 10/1980 | Roberts et al. | 114/74 A |
| 4,267,789 A | | 5/1981 | Ivanov et al. | 114/65 R |
| 4,548,154 A | | 10/1985 | Murata et al. | 114/335 |
| 4,573,422 A | | 3/1986 | Murata et al. | 114/65 R |
| 4,660,491 A | | 4/1987 | Murata et al. | 114/65 R |
| 4,674,430 A | | 6/1987 | Murata et al. | 114/355 |
| 4,907,524 A | | 3/1990 | Hart et al. | 114/356 |
| 5,090,351 A | | 2/1992 | Goldbach et al. | 114/65 R |
| 5,189,975 A | | 3/1993 | Zednik et al. | 114/74 A |
| 5,218,919 A | | 6/1993 | Krulikowski, III et al. | 114/74 A |
| 5,542,365 A | | 8/1996 | Jurisich et al. | 114/65 R |
| 6,170,420 B1 | * | 1/2001 | Hagner et al. | 114/65 R |

FOREIGN PATENT DOCUMENTS

| | | | |
|---|---|---|---|
| FR | 2 719 545 | | 10/1995 |
| JP | 61-24685 | * | 2/1986 |
| JP | 61-24686 | * | 2/1986 |

OTHER PUBLICATIONS

Maritrans Inc. Annual Report, 1997.
Company Press Release, Sep. 8, 1997: "Maritrans Inc. Will Seek Shipyard Bids For Pilot Double–Hull Retrofit Project," Internet: http://biz.yahoo.com.
Maritrans Signal, "A View From The Top: We'd Like to Thank 536 of the Most Environmentally Caring People in the World," by Stephen van Dyck, Fall 1998, pp. 1. 12, and 13.

(List continued on next page.)

*Primary Examiner*—Sherman Basinger
(74) *Attorney, Agent, or Firm*—Woodcock Washburn LLP

(57) ABSTRACT

An existing single hull vessel is rebuilt to provide a double hull vessel by cutting and removing the topside decking and internal vessel structure of the single hull vessel and inserting an inner hull structure within a volume defined by the original hull. The original hull defines an exterior (outer hull) of the rebuilt double hull vessel and the inner hull defines an interior cargo carrying volume and forms a boundary in the event that the outer hull is penetrated. In addition, a trunk structure, raised deck, and lower bulkhead portions may be used to prevent the loss of cargo carrying capacity due to the new double hull. The double hull covers at least the length of the cargo carrying section of the vessel along the bottom and sides of the cargo section. This method of internal double hulling results in the original vessel structure being reused to the maximum extent possible, and the major exterior dimensions and outer hull hydrodynamic characteristics of the vessel remaining substantially the same after the process of double hulling is complete.

8 Claims, 13 Drawing Sheets

OTHER PUBLICATIONS

"Firm Rebuilds Shipping Barge," Business and Finance Section of *The Tampa Tribune*, Nov. 7, 1998.
"Maritrans Completes First Double–Hull Barge Retrofit," *News Log*, Nov. 1998, pp. 19, 20, 22.
"Maritrans Is Making Waves," Great Ships of 1998, *Maritime Reporter/Engineering News*, pp. 26, 28, 44.
Letter from D. Jones to Penn Maritime re "Internal Double Hulling of the Morania No. 460," dated Dec. 6, 1996.
Drawing, "Midbody Scantling Details," Schuller & Allan, Inc., Oct 12, 1996.
Drawing, "Scantling Arrangement" Schuller & Allan, Inc., undated.
Drawing, "Revised & New Ballast Piping System" Schuller & Allan, Inc., Oct. 13, 1996.
Drawing, "Cargo Piping Modifications" Schuller & Allan, Inc., Oct 26, 1996.

* cited by examiner

REBUILT DOUBLE HULL VESSEL AND METHOD OF REBUILDING A SINGLE HULL VESSEL INTO A DOUBLE HULL VESSEL

CLAIM OF PRIORITY

This application is a continuation of 09/289,031, filed Apr. 9, 1999, now U.S. Pat. No 6,170,420, which claims priority to provisional application 60/112,394, filed Dec. 15, 1998.

FIELD OF THE INVENTION

The present invention relates to shipbuilding and vessel repair, and more particularly, the present invention relates to a rebuilt double hull vessel and method of rebuilding a vessel having an existing single hull into a vessel having a double hull. Even more particularly, the present invention relates to a rebuilt double hull vessel and method of internal double hulling, wherein the existing internal structure and deck of a vessel are cut out and removed from the shell of the existing single hull, a new inner hull is fabricated and installed inside the existing outer hull to form a double hull design, the original internal and deck structure is modified, fitted over, and then coupled to the new inner hull.

BACKGROUND OF THE INVENTION

The shipping and cargo moving industry is continually faced with customer demands for new and improved vessel designs and for new and improved methods of modifying the design of existing vessels. Substantial cost savings can be realized by a vessel owner in modifying or rebuilding existing vessels to incorporate improvements in vessel designs or otherwise extend the life of the vessel rather than paying the cost of building a new vessel.

In addition, new governmental and environmental regulations place certain restrictions and requirements on vessel owners and operators. These new or required designs must be capable of securely holding a cargo and also of being seaworthy. At the same time, a vessel must comply with shipping and environmental requirements and regulations.

A typical vessel comprises a vessel having a single hull design. This type of hull construction provides a single outer hull or skin that provides structural integrity and acts as a boundary between the operating environment of the vessel (e.g., the sea) and the cargo and internal structure of the vessel. The single hull typically includes a shell having a bottom, a port side, a starboard side, a bow, a stem, and a plurality of transverse and longitudinal bulkheads and internal stiffening frames that support and strengthen the shell of the hull. This internal framing typically comprises a combination of transverse and longitudinal members.

As a result of the recent heightened environmental awareness and several shipping mishaps, new governmental regulations have been implemented requiring the use of double hulls on designated vessels in U.S. waters out to the 200 mile economic zone limit. These double hull requirements are contained in the Oil Pollution Act of 1990 (OPA-90) and have been incorporated in U.S. Coast Guard regulations. In part, OPA-90 requires that all new tank vessels constructed under contracts awarded after 1990 must have double hulls and that all existing single hull vessels engaged in the marine transport of oil and petroleum products be rebuilt with double hulls or be retired between the years 1995 and 2015, depending on the size and age of the vessel.

This has created a great burden on carriers having existing single hull vessels. These single hull vessels will either have to be rebuilt to incorporate a double hull design at great cost to the carrier, or the vessel will have to be retired, in many cases years before the end of its economically useful life.

Double hull designs have been used in the construction of newer vessels in an effort to comply with the requirements of the OPA-90. These double hull vessels typically have an outer hull and an inner hull. The outer hull and the inner hull each have shell plating that forms the structural integrity of the hull. A combination of transverse and longitudinal framing is provided between the inner and the outer hull to help strengthen the shell plating. The idea behind a double hull is that the structural integrity of the outer hull may be breached without breaching the inner hull. Therefore, the outer hull may be breached, i.e., opened to the sea, while the cargo would remain securely contained within the inner hull. Thereby, a potential cargo spill will have been avoided. Typical cargos that have spilled in the past to cause environmental mishaps include cargos such as an oil, a petroleum, a chemical, or other hazardous materials. Of course the provision of a double hull adds to the complexity and cost of new construction. "METHOD AND DEVICE FOR THE INSTALLATION OF DOUBLE HULL PROTECTION", U.S. Pat. No. 5,218,919, issued on Jun. 15, 1993, Krulikowski et al. describes the construction of an auxiliary hull, exterior to the primary hull of a ship, which has the capacity to absorb impact energy preventing primary hull puncture, which may be retrofitted to existing single hull ships. However, this external fitting of a new auxiliary hull outside the existing single hull to form a double hull is costly and significantly changes the operational characteristics of the vessel. The breadth and draft of the ship are changed as a result of this external double hulling. This affects the ports that the vessel may access and the port interface characteristics of the vessel. Additionally, as is the case of a vessel with a pushing notch, an external double hulling will change the tugboat interface. External double hulling also affects the wave and wind characteristics of the vessel. In addition, the cargo carrying capabilities of the vessel may be affected, which in turn may affect the customers that may be serviced by a particular vessel.

Therefore a need exists for the rebuild of an existing single hull vessel with a new double hull. Preferably, this double hulling maintains the external shape and dimensions of the outer hull so that the vessel's hull performance and operational characteristics remain substantially the same.

SUMMARY OF THE INVENTION

The present invention is directed to a double hull vessel (particularly a seal going vessel) and a method of internally rebuilding an existing vessel having a single hull design into a vessel having a double hull design. The present invention accomplishes the installation of the new double hull using an internal rebuild concept. The present invention reuses the existing vessel structure to the maximum extent possible, while also maintaining, as much as possible, the cargo carrying and hull operational characteristics of the original vessel. The shape and dimensions of the outer hull of the vessel and the hull performance characteristics of the vessel remain substantially the same, and the existing internal ship structure, including the longitudinal bulkheads, the transverse bulkheads, and top side decking are removed, modified, and reused to the maximum extent possible.

The outer hull of the existing single hull vessel and a new inner hull, which is disposed within a volume defined by the outer hull, define the double hull of the rebuilt vessel. A plurality of framing members are disposed between the inner hull structure and the outer hull and maintain the inner hull in a spaced apart relationship with the outer hull. The new inner hull defines an interior cargo carrying volume and the outer hull defines an exterior of the rebuilt vessel, such that the inner hull provides a boundary in the event that the outer hull is penetrated.

Preferably, the new inner hull structure which forms the new inner hull of the double hull vessel is prefabricated as a plurality of modular sections, and the prefabricated modules are fitted over the top of the existing bottom framing members and joined to the existing framing members at the sides. The prefabricated modules comprise portions of the inner hull plating including the inner bottom plating, port side plating, and starboard side plating, and a plurality of framing members. The framing members include stiffening, members and connecting members. In one preferred embodiment, the connecting members include a plurality of transverse framing members and the stiffening members include a plurality of longitudinal framing members. Alternatively, the connecting membersmay include a plurality of longitudinal framing members and the stiffening members may include a plurality of transverse framing members. The connecting members are connected at one end to an exterior surface of the inner hull structure and extending therefrom and are connected at the other end to the outer hull structure.

The new portions of the primary framing members of the modular sections extend from the inner bottom plating a shorter distance than the new portions of the connecting members, thereby forming a gap when the module is installed over the existing framing. This gap helps facilitate fitting up and welding of each modular section to the existing outer hull structure. The removed internal ship structure and topside deck is modified and then reinstalled over the new inner hull after the inner hull has been installed. Thus, the cargo is primarily contained by new steel (the inner hull), and the exterior structure and coating of the original vessel's hull define the outer hull of the vessel.

Accordingly, a single hull vessel is rebuilt to have a double hull over at least the entire side and bottom within the length of the cargo carrying volume, while substantially maintaining the major outer hull exterior dimensions and hull hydrodynamic characteristics of the original single hull vessel.

In accordance with a further aspect of the present invention, a new trunk structure is disposed over the opening formed in the topside deck plating when the cut out section of deck plating was removed. The trunk structure includes topside deck (main deck) plating, preferably the existing decking that was cut and removed, and new bulkheads, extending down therefrom. The trunk bulkheads are formed between the cut in the original main deck, in the area where the original topside deck plating and bulkheads were raised to maintain cargo carrying capacity. Preferably, where a new trunk structure is employed, new bulkhead portions are connected to the existing longitudinal and transverse bulkheads to form rebuilt bulkheads. These bulkhead portions are preferably formed as lower bulkhead portions proximate the inner hull to strengthen the rebuilt bulkheads and to provide additional support and strength for the new raised deck and trunk structure. Preferably, new lower portions of the transverse and longitudinal bulkhead are formed extending upward from an inner surface of the new inner hull plating. The trunk structure may be sized to increase or decrease the cargo carrying capacity.

Additional features of the present invention are set forth below.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an exemplary embodiment that is presently preferred, it being understood, however, that the invention is not limited to the specific methods and instrumentalities disclosed. In the drawings.

DETAILED DESCRIPTION OF THE PREFERRED EMBODIMENTS

Figure 1A:
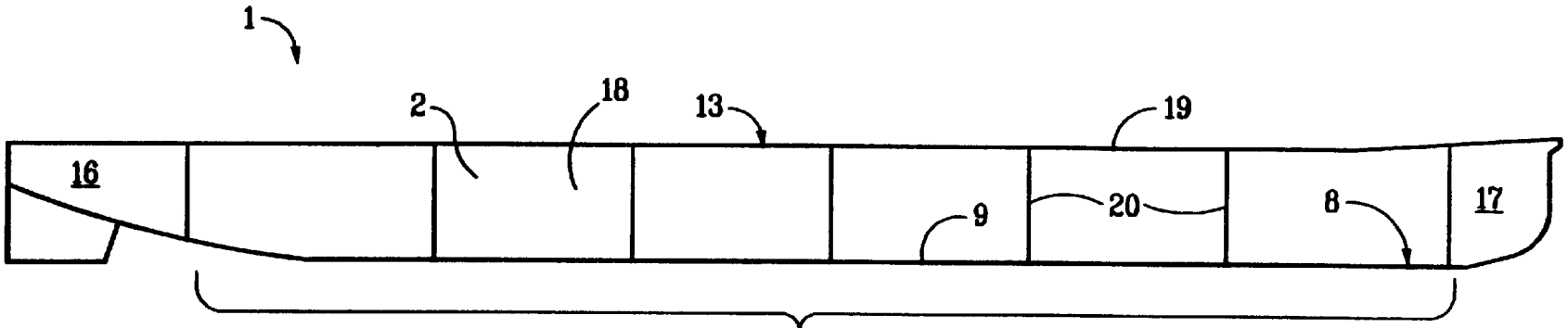
FIGS. 1A and 1B show a side view and a top plan view, respectively, of an exemplary single hull vessel for double hull rebuild in accordance with the present invention.

A rebuilt double hull vessel and method of vessel construction/rebuild that solve the above-mentioned problems in the prior art and provides other beneficial features in accordance with the presently preferred exemplary embodiment of the invention will be described below with reference to FIGS. 1–9. Those skilled in the art will readily appreciate that the description given herein with respect to those figures is for explanatory purposes only and is not intended in any way to limit the scope of the invention. Throughout the following detailed description similar reference numbers refer to similar elements in all the figures of the drawings.

The vessel and method of internal double hull rebuild are described in reference to a rebuild, conversion, and/or retrofit of an existing oil, or petroleum, or chemical carrying vessel, but it is contemplated that the invention is applicable to other types of vessels as well, and is not limited to the particular vessel embodiments shown. For example, the invention contemplates the use of other vessel types, such as ships and barges for the transportation of liquid, granular, and gaseous cargos, as well as other vessel structures, different methods of coupling various parts of the vessel together, and the use of various materials for the construction/rebuild of the vessel.

The present invention is directed to a rebuilt double hull vessel and method of rebuilding an existing vessel 1 having a single outer hull 2 into a rebuilt vessel 5 having a double hull 4. This vessel and method of internal double hulling results in a "ship within a ship" like construction. More specifically, it is directed to a rebuilt double hull vessel 5 having a new inner hull 6 that is adapted to be fitted inside the volume defined by the outer hull 2 and to be coupled to the outer hull 2 of an existing vessel 1 thereby forming a double hull 4. The double hull 4 includes an inner hull 6 formed by an inner hull structure 3 and an exterior or outer hull 2 defined by the original hull 2 of the existing vessel 1. The inner hull 6 defines an interior cargo carrying volume 12 and the outer hull 2 defines an exterior of the rebuilt vessel 5. The inner hull structure 3 allows for the internal rebuild of an existing single hull vessel 1 into a double hull vessel 5 while at the same time maintaining the original outer or exterior hull material, exterior hull shape, exterior hull dimensions, and exterior hull performance characteristics. The new inner hull structure 3 is also adapted for forming a connection to the original internal vessel structure 7.

The present invention is also directed to a new method of internal double hulling wherein the outer hull 2 of an existing vessel 1 is rebuilt internally from a single hull to a double hull 4. The method of double hull rebuild includes the steps of removing substantially all of the existing internal structure 7 proximate the cargo section 12 (herein after also referred to as cargo carrying volume) of the vessel 1, inserting a new inner hull structure 3 within the volume defined by the existing outer hull 2, thereby forming an inner hull 6 of a double hull 4, and then reinstalling the modified existing internal vessel structure 7 over the new inner hull 6.

By rebuilding the hull from the inside out, the same outer hull shape and dimensions of the original single hull vessel are maintained. This is important for several reasons. By maintaining the same outer hull shape and dimensions, the wind and wave performance characteristics of the vessel are essentially the same after the rebuild as they were prior to the rebuild The vessel interface with port facilities and tugboats are maintained. Also, the new inner hull 6 having new metal and surface coatings is used to hold the cargo. The existing hull 2, which is already proven to be seaworthy, to have the proper structural, stiffness, and the proper corrosion coating required for a seawater environment, is still on the outside or exterior of the new double hull 4. This method of internal double hulling allows the vessel to also maintain essentially the same beam characteristics. This allows the same ports to be accessed by the vessel, and the same customers to be serviced after the rebuild that were serviced prior to the rebuild.

The double hull 4 extends over at least the entire outer shell plating 18 (e.g., outer bottom plating 9, outer port side plating 10 and outer starboard side plating 11) within the length of the cargo carrying section 12 of the double hull vessel 5 in order to protect the cargo from spillage in case of penetration of the outer hull 2. The existing internal structure 7 that was removed may be modified such that the topside decking 13 that was removed is adapted to be reconnected to the topside decking 13 that was left in place, or preferably, a trunk structure 53 is added between the topside decking 13*b* that was left in place and the topside decking 13*a* that was removed to maintain the cargo carrying capacity of the double hull vessel 5 substantially the same as that of the single hull vessel 1. Preferably the trunk structure 53 has a height sufficient to prevent a loss in the cargo carrying capacity, although the trunk structure 53 may be designed to increase, decrease, or maintain the cargo carrying capacity.

The present invention allows for the installation of a double hull 4 into an existing vessel 1 having a single hull design and has the advantages of maximizing the amount of existing structure that is reused in the rebuild construction. In addition, the present invention provides for prefabrication of the material and structure of the new inner hull 6. Preferably the inner hull structure 3 is prefabricated into a plurality of modular sections 15 to reduce the repair time. This rebuild or retrofit process saves a substantial amount of time and money due to the fact that the original vessel's hull 2 and internal structure 7 is reused. Also, the present invention provides a level of confidence in the operation and performance of the rebuilt double hull vessel 5 due to the fact that the design and seaworthiness of the outer hull 2 of the rebuilt double hull vessel 5 has already been proven in-service.

Figure 1B:
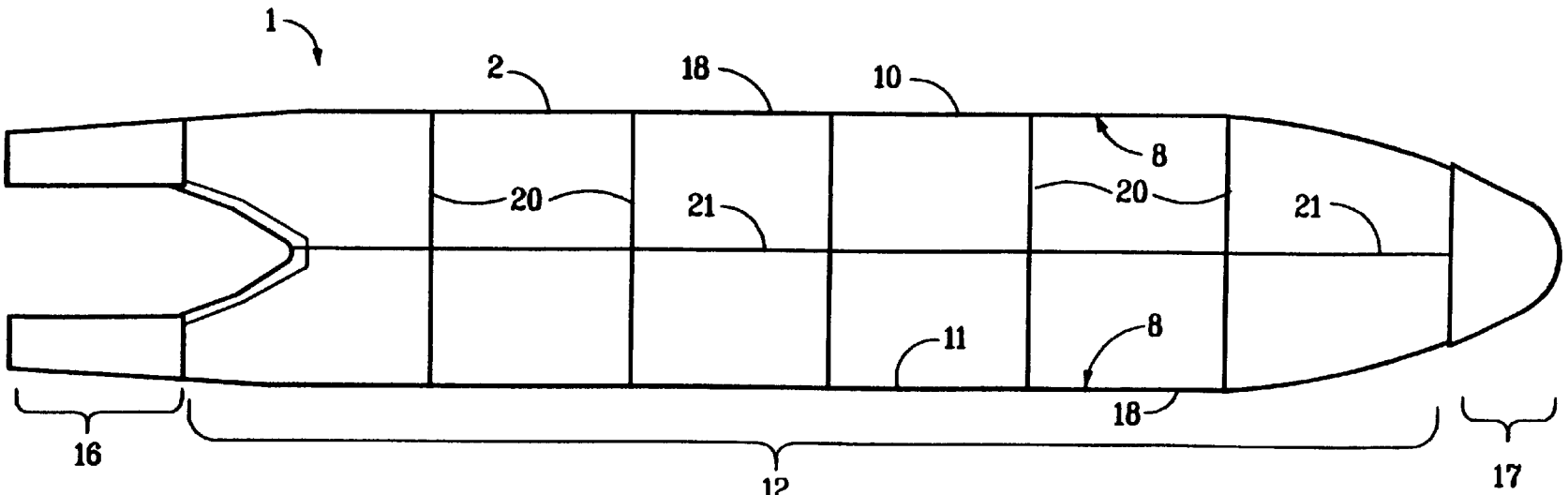

FIGS. 1A and 1B show a typical single hull vessel 1. As shown, the single hull vessel 1 includes a stem section 16, a bow section 17, and a cargo canying section 12 located midships between the stern section 16 and the bow section 17, as are conventional. The stern section 16 and bow section 17 typically include main propulsion systems, mechanical systems, electrical systems, cargo and ship handling equipment, crew living quarters, and the like as are conventional.

As shown in FIGS. 1A and 1B, a single exterior or outer hull 2 extends the length of the vessel 1 from the stern 16 to the bow 17. The outer hull 2 is formed of outer shell plating 18 including outer bottom plating 9, outer port side plating 10, and outer starboard side plating 11. Top side deck plating 13 extends laterally across the top edges 19 of the side plating 10, 11 from the stern 16 to the bow 17. One or more cargo carrying sections 12 are typically formed midships between the bow section 16 and the stern section 17. The cargo section 12 defines the cargo carrying volume of the vessel and may be divided transversely by one or more transverse bulkheads 20 and/or longitudinally by one or more longitudinal bulkheads 21. These bulkheads 20, 21 are watertight solid structures that divide the cargo section 12 of the vessel 1 into one or more tanks which physically separate the cargo.

Figure 2A:
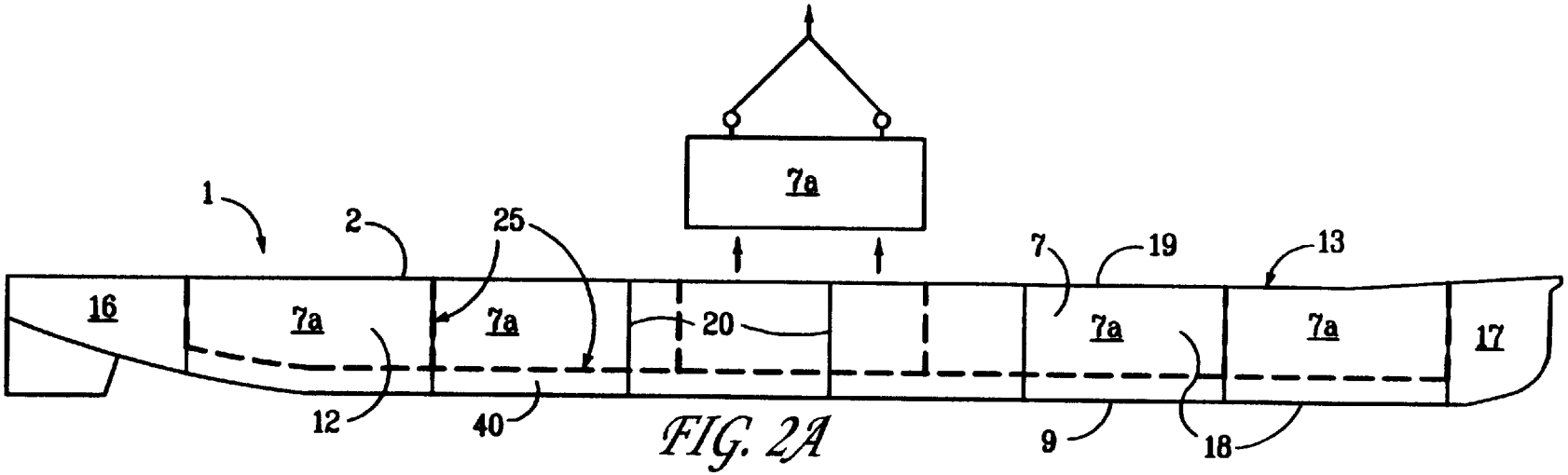
FIG. 2A shows a side view of the vessel of FIG. 1 illustrating with dashed lines the cut lines for removal of the existing internal vessel structure and topside decking.
Figure 2B:
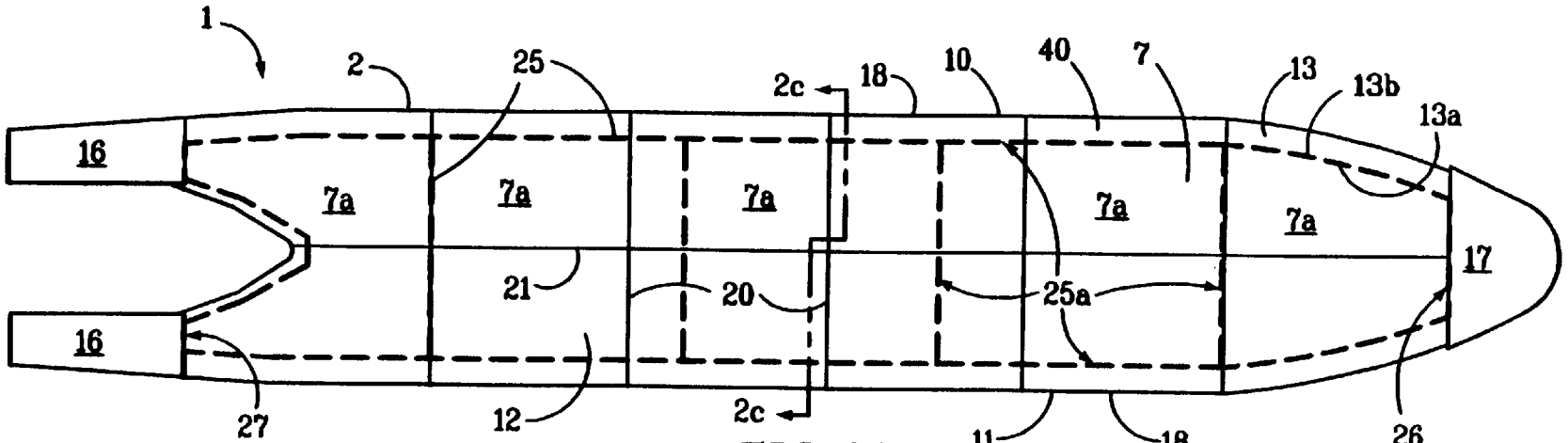
FIG. 2B shows a plan view of the cut lines of FIG. 2A.
Figure 2C:
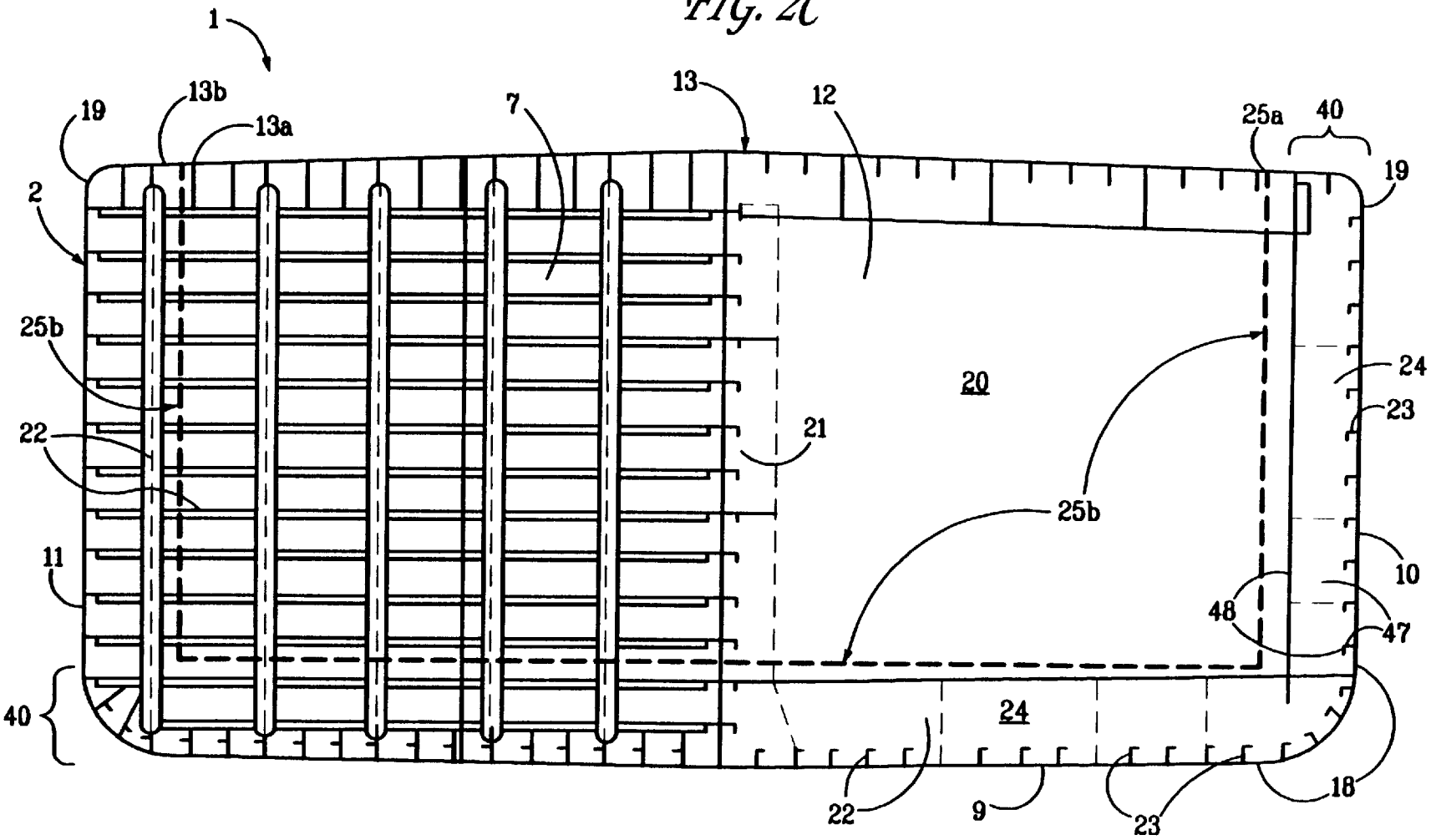
FIG. 2C shows a cross-sectional view taking along line 2C—2C of FIG. 2B showing the cut lines.

As shown in FIG. 2C, the outer hull's 2 shell plating 18 is supported and strengthened by a plurality of outer framing members 22 and bulkheads 20, 21. These outer frames 22 and bulkheads 20, 21 typically include outer longitudinal frames 23 and bulkheads 21 that run generally fore and aft (lengthwise), and outer transverse frames 24 and bulkheads 20 that run generally port to starboard (side to side).

Figure 6A:
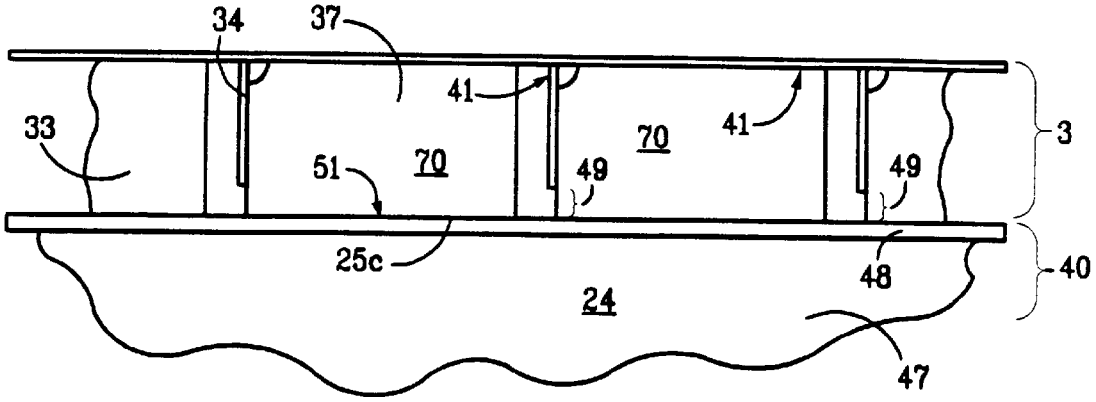
FIG. 6A is a detailed end view of an exemplary connection of the inner hull structure to the outer hull of FIG. 5C and FIG. 5D.
Figure 6B:
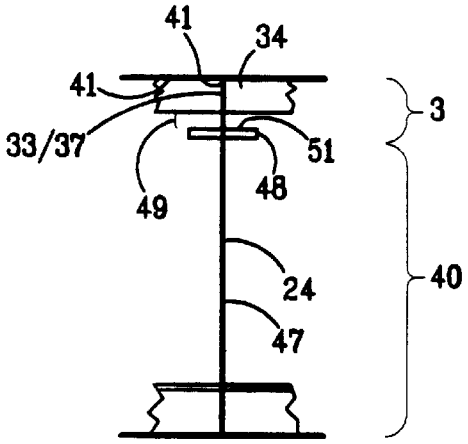
FIG. 6B is a detailed side view of the connection of FIG. 6A.

The outer framing members 22 typically include a first leg 47 and a second leg 48. The first leg 47 extends from the interior planar surface 8 of the outer shell plating 18 in a plane substantially perpendicular to the interior planar surface 8. The second leg 48 extends transversely in relation to the first leg 47 and forms a plane that is substantially parallel to the interior planar surface 8 of the outer shell plating 18. For example, FIGS. 6A and 6B show a typically outer transverse framing 24 that includes I-beam type framing wherein the first leg 47 is a web, and the second leg 48 is a flange. The outer longitudinal framing 23 typically includes angle bar type framing, as is conventional The outer framing members 22 may comprise web frames which are not solid structures, but rather have passages (not shown) formed therein which allow the cargo or contents of a tank to flow through the web framing member.

FIGS. 2A, 2B, and 2C show dashed lines that illustrate preferred cut lines 25 for an exemplary single hull vessel 1 that will be rebuilt into a double hull vessel 5. The cut lines 25 show a preferred location for cutting and removing the existing internal vessel structure 7 from the existing single hull 1 in preparation for installing the new inner hull 6 inside the original outer hull 2 to form the double hull 4. As shown, a cut 25 is preferably made along the existing hull 1 around the perimeter of the cargo carrying section 12 (e.g., the top, bottom, sides, and ends of the cargo carrying section). As shown in FIGS. 2B and 2C, a cut 25*a* is preferably made in the topside plating 13 in an area above the cargo section 12 proximate the outer perimeter of the topside deck plating 13 (e.g., longitudinally along the port side 10, transversely along the forward end 26 of the cargo section 12, longitudinally along the starboard side 11, and transversely along the after end 27 of the cargo section 12). An opening is formed in the topside deck plating 13 once the cut out section of the topside deck plating is removed. As shown in FIGS. 2 and 2C, a cut 25*b* is also made proximate the outer port side plating 10, outer starboard side plating 11, and outer bottom plating 9, and along both the transverse 20 and the longitudinal 21 bulkheads. The cut 25*b* preferably follows the contour of the outer hull 2 and is made near the transverse 24 and longitudinal 23 framing of the outer hull 2. The cuts 25 are made using conventional techniques.

As shown in FIG. 2A, the cut internal vessel structure 7 is then removed from the outer hull 2 using conventional lifting techniques. Preferably, the internal vessel structure 7 is cut into a plurality of sections 7*a* to help facilitate removal of the internal vessel structure 7 from the shell of the outer hull 2, as shown in FIGS. 2A, 2B, and 2C. The internal vessel structure 7 may be cut into sections 7*a* in the longitudinal direction, the transverse direction, or both. The number of sections 7*a* that the internal vessel structure 7 is cut into is preferably predetermined taking into account several factors, including the type of vessel, the size of the vessel, a maximum number of sections that helps facilitate removal of the sections from the existing outer hull, the crane capacity for lifting, and a minimum number of sections that helps facilitate reinstallation of the sections back into the new inner hull. After the cut sections 7*a* are lifted out, the sections 7*a* are modified so that they may be reinstalled over and connected to the new inner hull 6. This modification of the removed internal vessel structure 7 is preferably performed off-site.

As shown in FIGS. 2A, 2B, and 2C, most of the topside decking 13 and internal vessel structure 7 of the cargo section 12 is cut and removed from the shell of the outer hull 2. FIG. 2C shows a simplified cross-sectional view of the midship cargo section 12 of the vessel 1, looking aft, and showing the configuration of the vessel prior to being cut apart. The left half is a section forward of a typical web frame while the right half is a section forward of a typical transverse bulkhead. FIG. 2C additionally shows schematically the placement of the external vessel structure 40, including the outer shell plating 18, the outer transverse flaming 24, and the outer longitudinal framing 23. The external vessel structure 40 remains in place in the outer hull 2 in the area of the cargo section 12 after the cuts 25 have been completed. In addition, other ship systems (not shown) that run through or are contained in the cargo section 12 of the vessel 1 may be left intact, provided that they do not interfere with the installation of the new inner hull 6. The existing external structure 40 on the topside deck plating 13, outer bottom plating 9, and outer side plating 10, 11 of the vessel 1 that was cut and remains in place is adapted to receive and be connected to the new inner hull 6. This external vessel structure 40 is adapted using conventional techniques.

Figure 3:
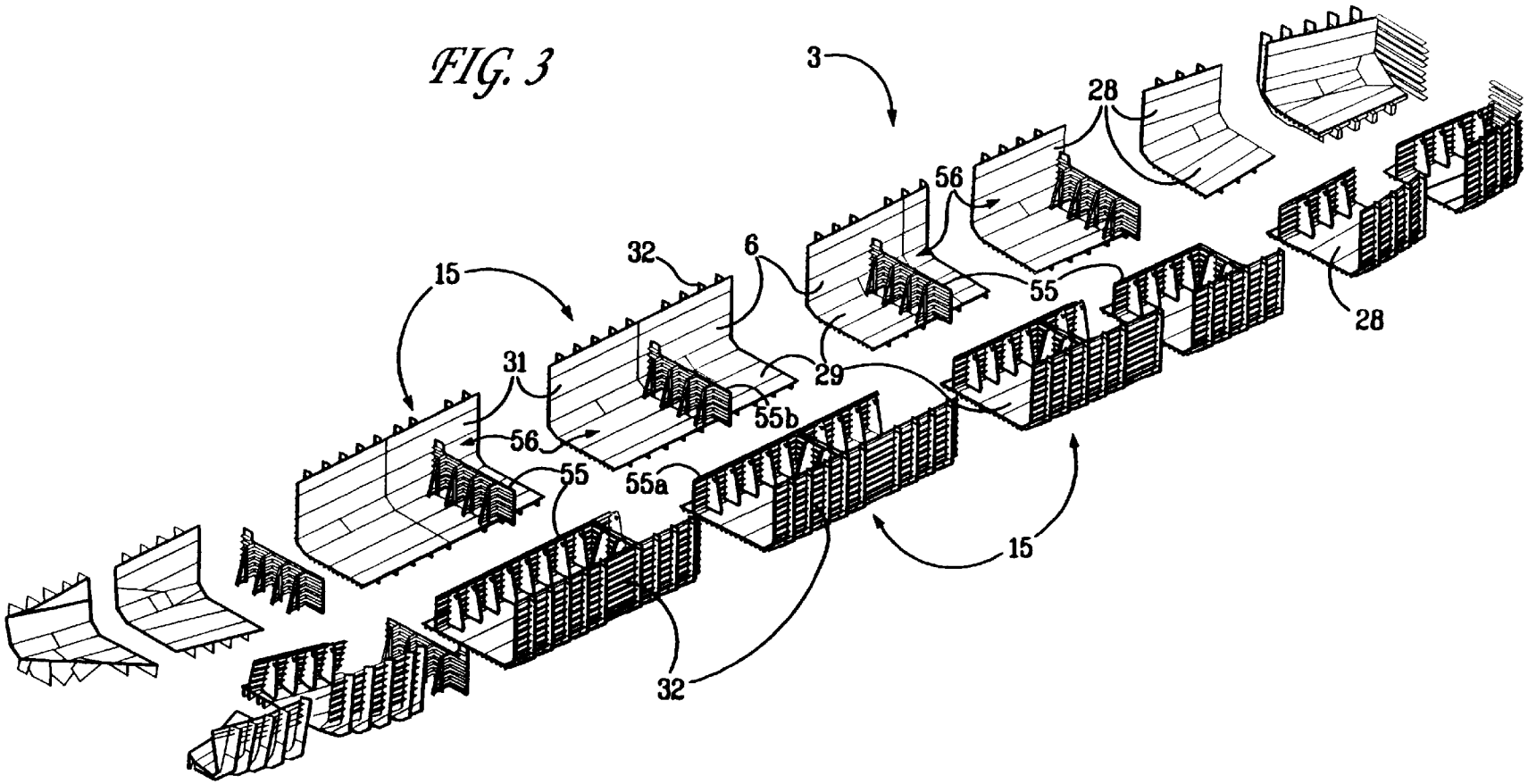
FIG. 3 shows a perspective, exploded view of an exemplary inner hull structure of the present invention.

FIG. 3 shows the new inner hull 6 that will be inserted inside the shell plating 18 of the outer hull 2 to rebuild an existing single hull vessel 1 into a double hull vessel 5. Once installed within the volume defined by the outer hull 2, the inner hull 6 defines an interior cargo carrying volume 12 and the outer hull 2 defines an exterior of the rebuilt vessel 5. The inner hull 6 includes an inner hull structure 3 including inner hull shell plating 28 and inner framing members 32. The inner shell plating 28 including inner bottom plating 29, inner port side plating 30, and inner starboard side plating 31. Preferably, the new inner hull structures also comprises a plurality of inner framing members 32 that include a plurality of inner connecting members 33 and a plurality of inner stiffening members 34 that are disposed between the inner hull structure 3 and the outer hull 2. The inner hull structure 3 may also comprise lower bulkhead portions 55, as will be discussed further below. The new inner hull 6 is adapted to be disposed within and connected to the inside of the outer hull 2, adapted to receive the cut and removed internal vessel structure 7, and also to accommodate and fit up with existing shipboard systems and equipment (not shown). In addition, piping or equipment of various vessel systems (not shown) may be included on the new inner hull structure 3 as required.

The volume defined by the spaced apart area between the outer hull 2 and the inner hull 6 preferably forms a space 38 that may be used as tanks for the rebuilt double hull vessel 5, including ballasting tanks or the like. The new ballast spaces 38 may be used to optimize vessel trim and heel, to provide additional propeller immersion, or to minimize wind and weather sensitivity. Additionally, this feature has importance for single hull vessels 1 that carry segregated ballast. After a single hull vessel 1 having segregated ballast tanks has been rebuilt into a double hull vessel 5, the majority of the segregated ballast tanks may be converted to cargo tanks, thus increasing the cargo volume capacity. This increased cargo volume capacity results from the fact that space 38 created by the formation of the double hull 4 may serve as ballast tanks providing ample volume for ballast, and since the segregated ballast tanks are no longer necessary for the carrying of ballast, they may carry cargo.

Figure 4:
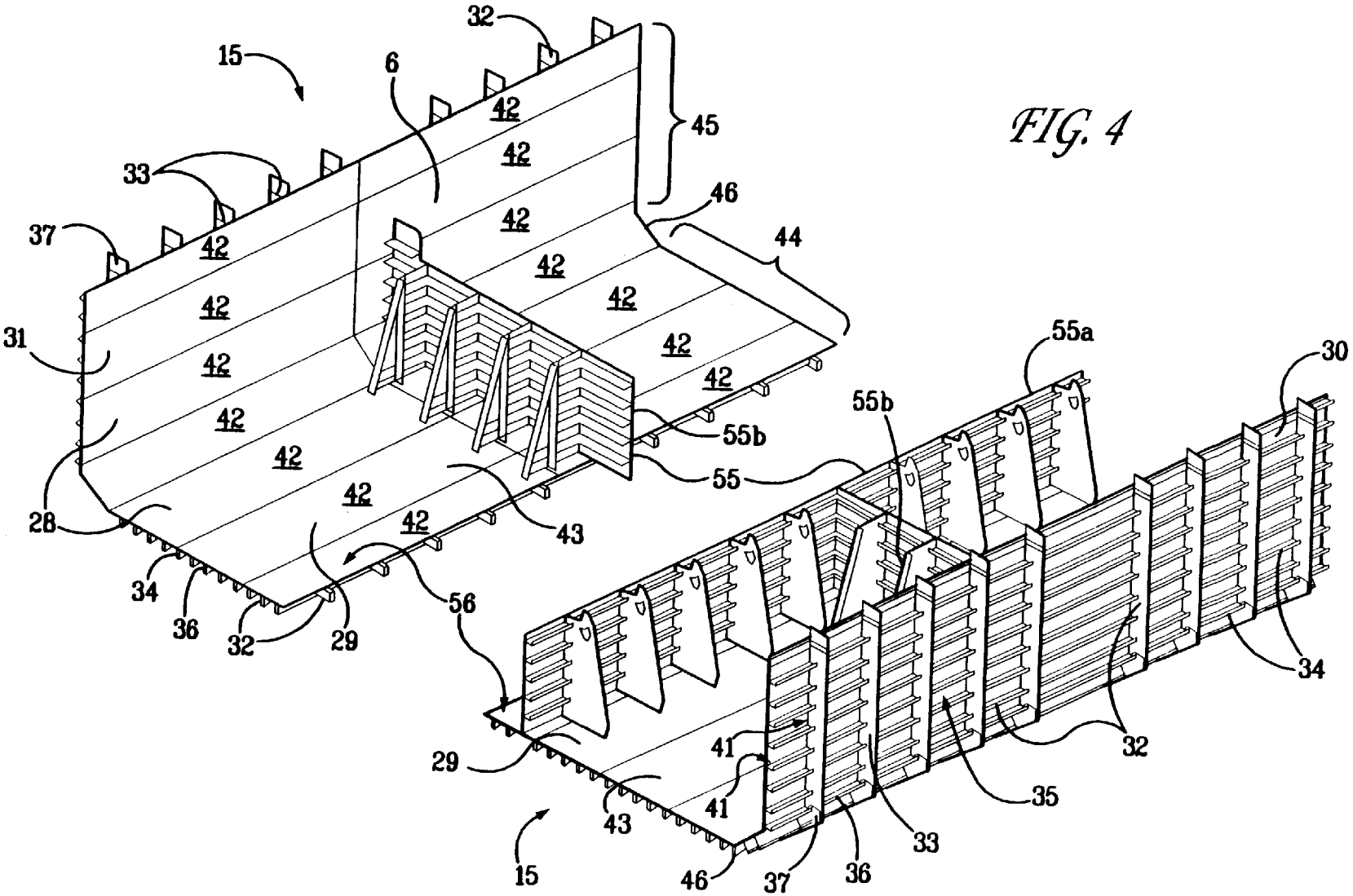
FIG. 4 shows a detail view of an exemplary port modular section and an exemplary starboard modular section of the inner hull structure of FIG. 3.

As shown in FIGS. 3 and 4, the new inner hull 6 is preferably constructed and installed as a plurality of prefabricated modular sections 15. These individual modular sections 15 are constructed at yard level, transported to the vessel 1, lifted into the interior of the outer hull 2, laid on top of the existing external vessel structure 40 that was left in place after the cut, aligned with the external vessel structure 40 that was left in place and adjacent modular sections 15, and integrated with the external vessel structure 40 and adjacent modular sections 15, as shown in FIGS. 5C, 6A, and 6B. The modular sections 15 of the new inner hull structure 3 are connected together and to the external vessel structure 40 by conventional techniques, preferably by welding. Prefabrication of the new inner hull structure 3 allows for a shorter rebuild or repair time and therefore the vessel is out of service for a shorter period of time.

As shown in FIG. 4, each new inner hull modular section 15 preferably includes a portion of inner bottom plating 29 and a portion of inner side plating 30, 31. In addition, each modular section 15 includes a plurality of inner framing members 32 extending from an exterior surface 35 of the inner shell plating 28 (e.g., the inner bottom plating 29, inner port side plating 30, and inner starboard side plating 31). The size of each modular section 15 is predetermined base on several factors, including the type of vessel, the size of the vessel, a maximum number of modules 15 that helps facilitate installation of the modules 15 into the volume of the existing outer hull 2, the crane lifting capacity, and a minimum number of modules 15 that helps facilitate the fitting up and welding of the modules 15 to the outer hull 2.

The inner bottom plating 29 and inner port and starboard side plating 30, 31 generally include a plurality of flat metal plate structures 42 having parallel planar surfaces. These individual flat metal plate structures 42 are coupled together to form a plurality of plate assemblies 43. The plurality of plate assemblies 43 include bottom plating assembly 44 and side plating assembly 45 that are connected together. The corner 46 formed at the connection of the bottom plating assembly 44 and side plating assembly 45 may form a right angle or preferably comprises a joint that is formed such that the bottom and side plating assemblies 44, 45 follow the general contour of the outer hull 2.

Temporary bracket members (not shown) may be used to hold the inner bottom plating 29 and the inner side plating 30, 31 constant in relation to one another during fitting and make-up of the new inner hull 6 to the existing outer hull 2. Once the inner hull structure 3 has been connected inside the outer hull 2, these temporary bracket members are cut off and removed.

Figure 5A:
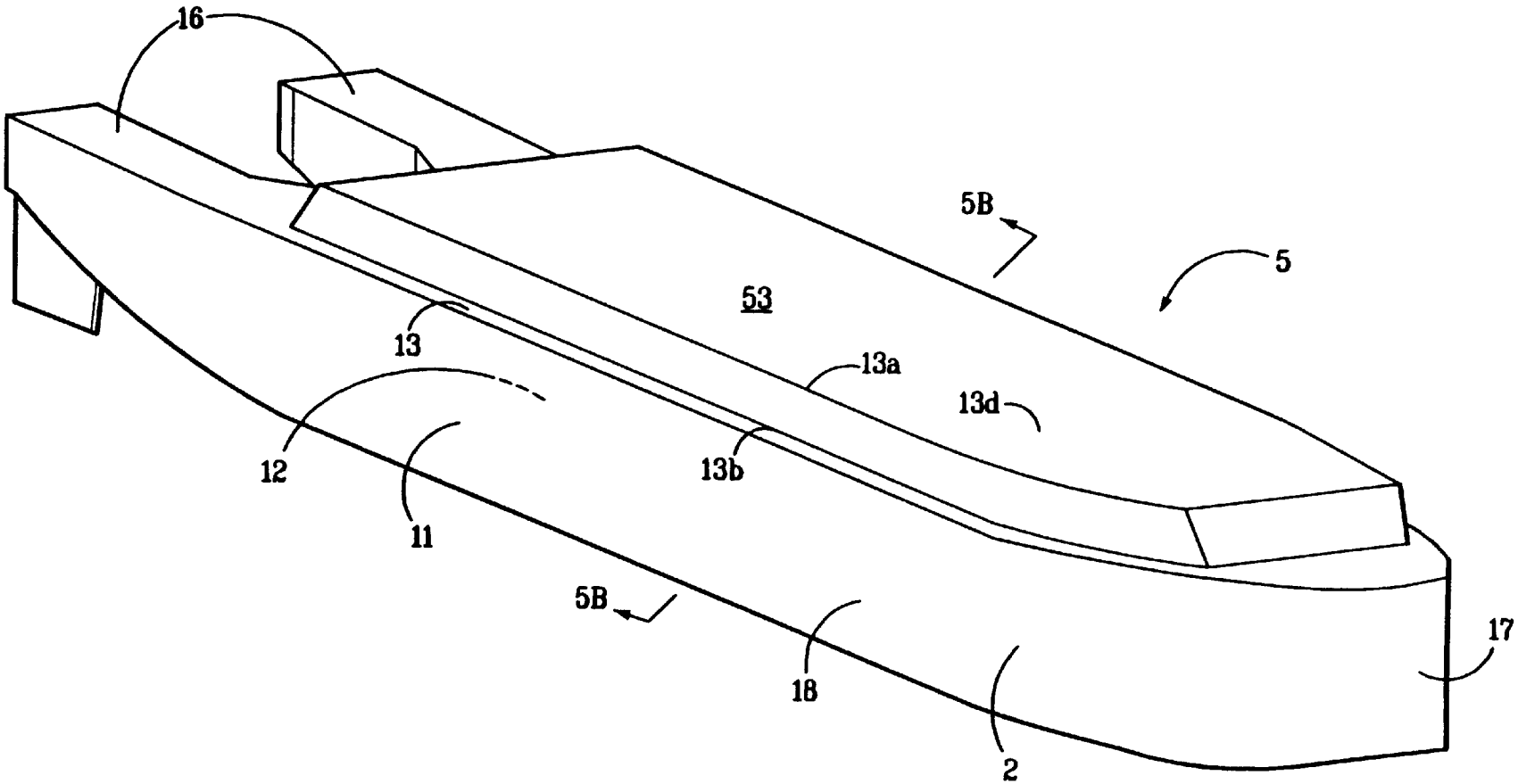
FIG. 5A is a perspective view of a rebuilt vessel having a double hull and a raised trunk structure according to the present invention.
Figure 5B:
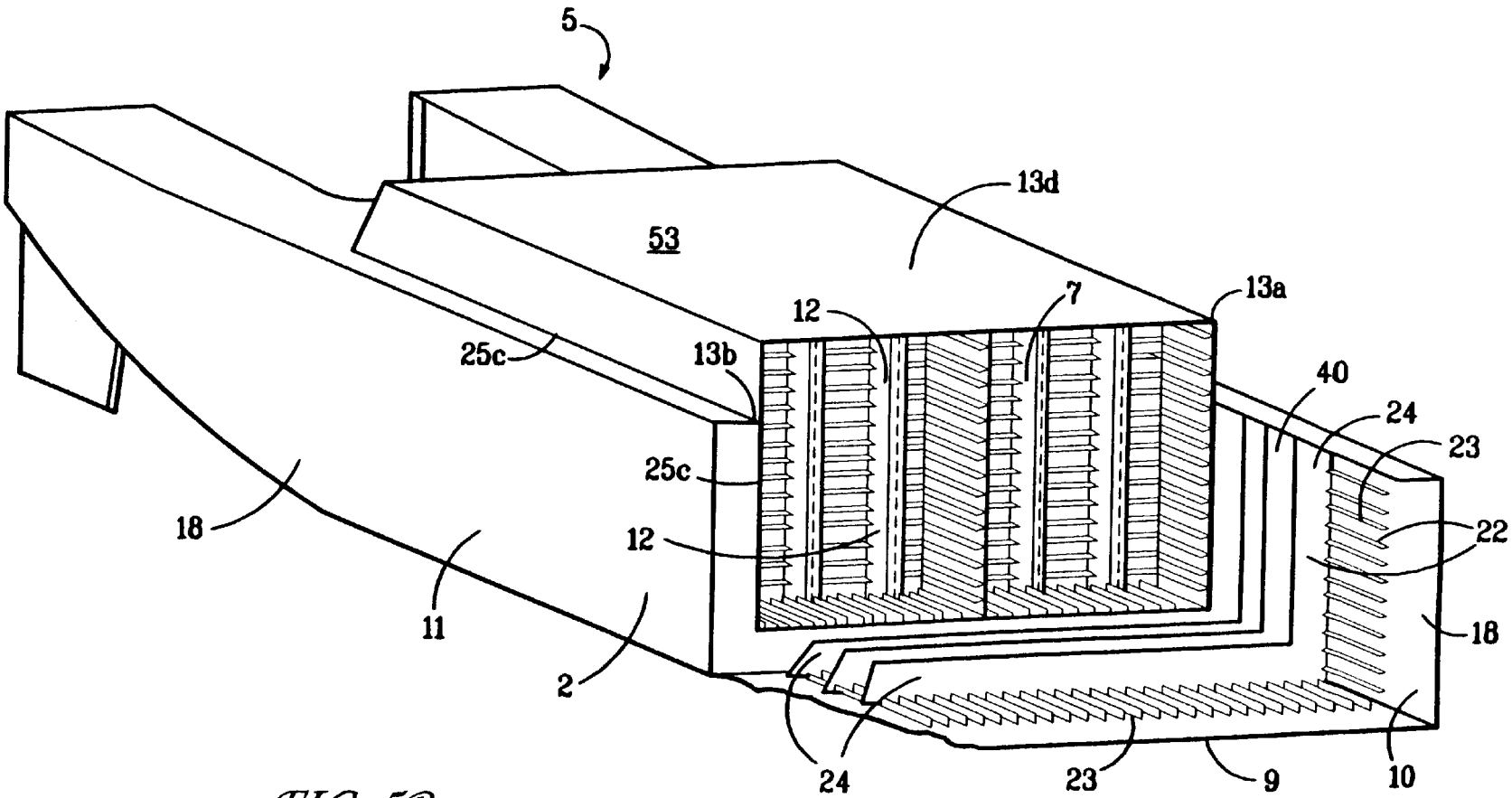
FIG. 5B is a perspective cross-sectional view taken along line 5B—5B of FIG. 5A.
Figure 5C:
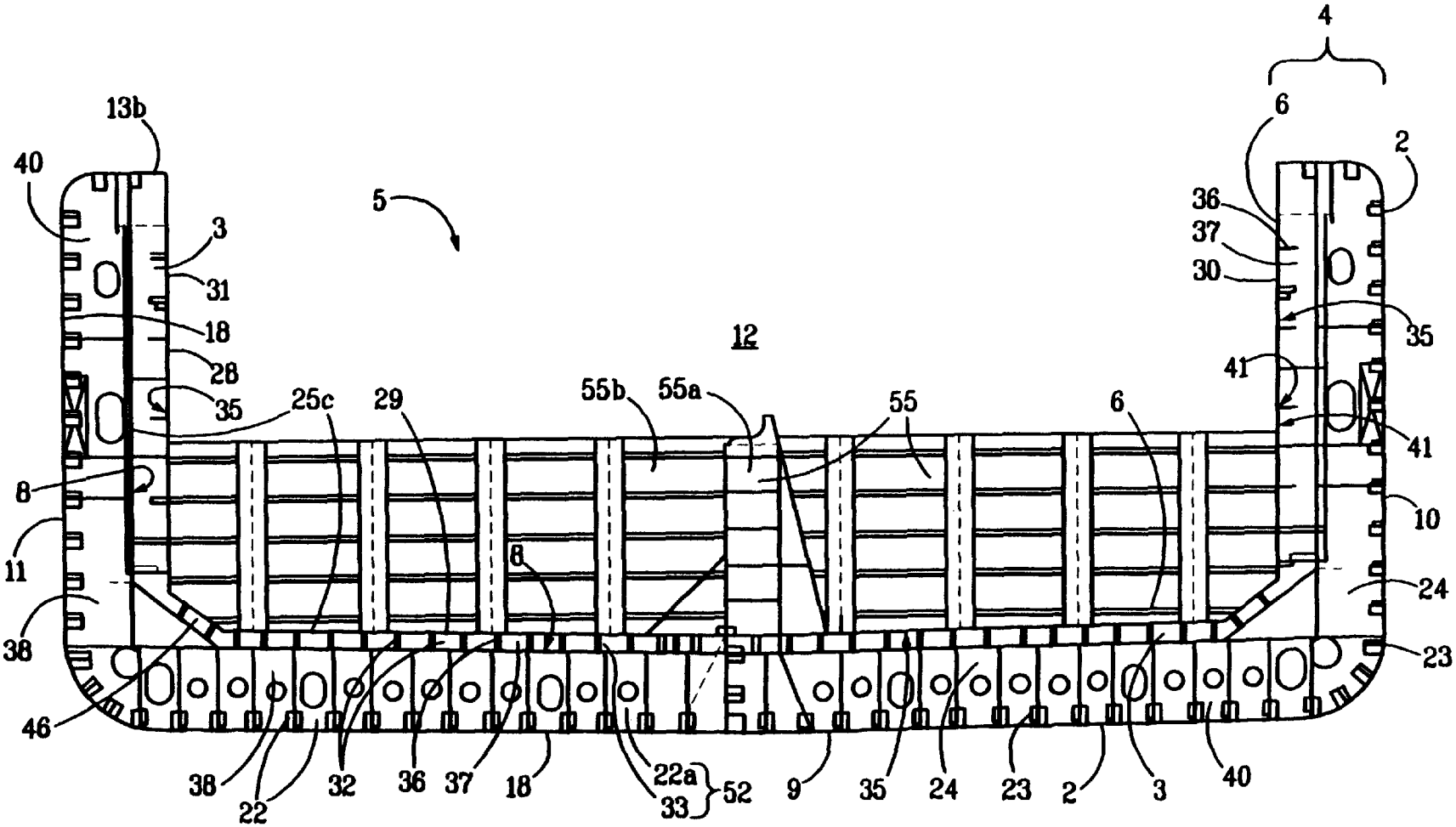
FIG. 5C is a cross-sectional detail view taken along line 5B—5B of FIG. 5A.
Figure 5D:
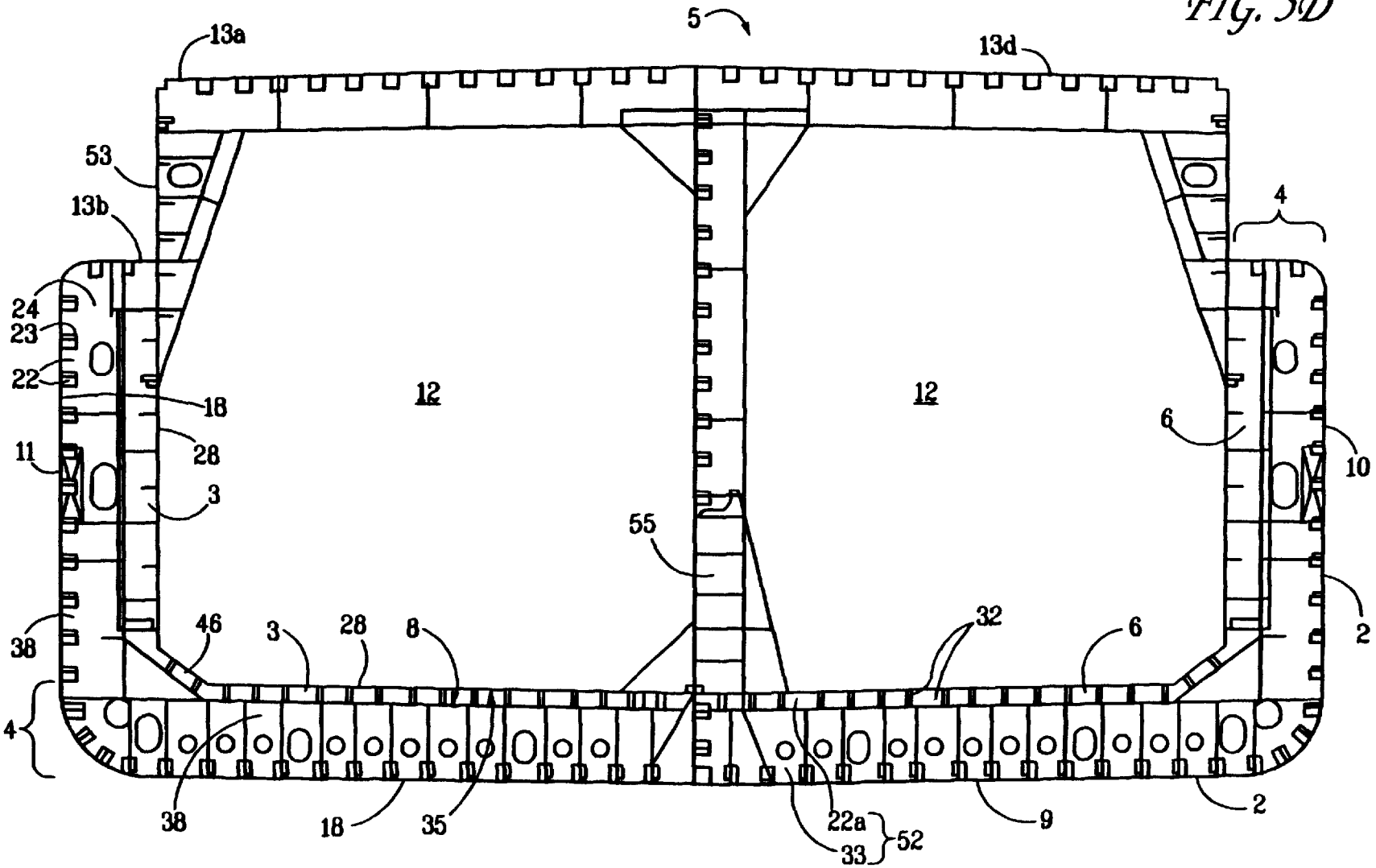
FIG. 5D is a cross-sectional view taken along line 5B—5B of FIG. 5A illustrating the inner hull structure of the new double hull and the raised trunk structure.

As shown in FIGS. 5C and 5D, a plurality of elongated inner framing members 32 are disposed between the spaced apart inner hull 6 and outer hull 2. As shown in FIGS. 3 and 4, the inner framing members 32 are preferably attached to the exterior surface 35 of the inner shell plating 28 in a parallel spaced relation to each other. Preferably, the framing members 32 are connected to and extend outward in a plane substantially perpendicular to a plane defined by the exterior surface 35 of the inner shell plating 28 (e.g., inner bottom plating 29, inner port side plating 30, and inner starboard side plating 31). Alternatively, the framing members 32 may be installed at a predetermined angle or comprise an energy absorbing type design.

As shown, the inner framing members 32 includes inner connecting members 33 that function to hold the inner hull 6 spaced apart from the outer hull 2, and inner stiffening members 34 that function to stiffen the planar surfaces of the inner bottom plating assembly 44 and the inner side plating assembly 45. Preferably, the inner framing members 32 include inner longitudinal frames 36 that run generally fore and aft, and inner transverse frames 37 that run generally port to starboard thereby forming a cris-cross structure. An inner end 41 of each inner framing member 32 is coupled to the inner shell plating 28 using conventional techniques, such as welding.

In a preferred embodiment shown in FIGS. 6A and 6B, the inner longitudinal frames 36 are formed as continuous members and functions as the primary stiffener of the new inner shell plating 28. In this preferred embodiment, the inner transverse frames 37 includes a plurality of chocks 70 disposed between the longitudinal frames 36. The inner transverse frames 37 are laid onto and fitted to the outer averse frames 24 of the outer hull 2. The distal ends 51 of the inner connecting members 33 are coupled to the outer transverse framing 24 by conventional welding techniques.

As shown in FIGS. 6A and 6B, a gap 49 is preferably formed at the location between where the distal ends 51 of the inner connecting members 33 (inner transverse framing 37) land on the second legs 48 of the outer transverse framing 24 and the distal end 50 of the inner stiffening members 34 (inner longitudinal framing 36) of the new inner hull 6. This gap 49 assists the fitting up and welding of the new inner hull structure 3 to the existing external hull structure 40 with improved efficiencies. For example, the gap 49 allows for the use of automated processes for connecting the inner hull structure 3 to the outer hull 2. Preferably, the gap 49 is formed by the inner transverse frames 37 of the new inner hull 6 extending a greater distance from the exterior side 35 of the inner shell plating 28 than the inner longitudinal frames 36 extend therefrom. The distal ends 51 of the inner transverse frames 37 are coupled to the second legs 48 of the outer transverse frames 24 of the existing outer hull 2 using conventional techniques.

The cut out section of topside deck plating 13*a* and internal vessel structure 7 that was cut and removed is adapted to be re-installed and connected to the new inner hull 6 and the cut portion of the topside deck plating 13*b* that was left in place defining an opening in the topside decking. The topside deck plating 13*a* and internal vessel structure 7 that was cut and removed may be adapted such that the topside deck plating 13*a* that was cut and removed is reconnected to the cut topside deck plating 13*b* that was left in place, forming a rebuilt topside deck that is substantially the same as the topside deck 13 of the original single hull vessel 1, or preferably, a new trunk structure 53 is added extending between the cut 25*a* in the topside deck plating 13*b* that was left in place and the topside deck plating 13*a* that was removed, resulting in a raised deck 13*d*, as shown in FIGS. 5A, SB, and 5D.

As shown in FIG. 5A the new double hull 4 extends at least the length of the cargo carrying section 12. FIG. 5B shows a cut-away perspective view of the new double hull 4 at the midship cargo section 12. FIGS. 5B and 5C illustrate how the new inner hull 6 is inserted within the volume defined by the outer shell plating 18 of outer hull 2, and also shows the outer framing members 22, the inner framing members 32, and the connection of the inner hull structure 3 to the outer hull 2. The inner hull 6 defines an interior cargo carrying, volume 12 and provides a secondary boundary in the event that the outer hull 2 is penetrated.

As shown in FIG. 5C, the inner hull structure 3 is inserted within a volume defined by the outer shell plating 18 of the outer hull 2, spaced apart from the outer hull 2 to form a double hull 4. Connecting members 52 connect the inner hull 6 to the outer hull 2 in a spaced apart relationship. Preferably, connecting members 52 include outer connecting members 22*a* and inner connecting members 33. In a preferred embodiment, outer connecting members 22*a* comprise the outer transverse framing 24 of the outer hull 2 and the inner connecting members 33 comprise the inner transverse framing 37 of the inner hull 6. The new inner hull structure 3 is inserted internally within the existing outer framing 22 of the outer hull 2. As shown, the inner transverse framing 37 extending from the exterior surface 35 of the inner hull 6 is coupled to the outer transverse framing 24 extending from an interior surface 8 of the outer hull 2. Preferably, the framing members on the bottom are laid together and the framing members on the sides are lapped or butted together. The connecting members 52 are designed to hold the inner hull 6 in a spaced apart relationship with the outer hull 2 and to withstand normal hydrostatic loads (e.g., the pressures of the cargo inside the double hull 4 and the pressures of an operating environment, such as the sea, on the exterior of the double hull 4).

Alternatively, the inner hull structure 3 and connecting members 52 may also comprise a curved plate design, a transversely framed design, transverseless framed design, an energy absorbing design, or any other suitable hull design as known in the art.

FIGS. 5A and 5B show an exemplary double hull vessel 5 rebuilt in accordance with the present invention. The removed internal vessel structure 7 and topside deck plating 13 is reinserted and coupled to the new inner hull 6 and the remaining external vessel structure 40 by conventional techniques, preferably by welding. Weld joints 25*c* join the inner hull 6 to the outer hull 2. The weld joints 25*c* illustrate where the inner hull structure 3, the removed internal vessel structure 7 and topside deck plating 13 are reconnected to the remaining external vessel structure 40. The location of the weld joints 25*c* essentially coincide with the cut lines 25*a* and 25*b*.

As illustrated in the embodiment shown in FIGS. 5A and 5B, the new double hull vessel 5 may include a new trunk structure 53 and raised deck 13d. FIG. 5D shows a cross-section taken amidship in the cargo carrying section 12 of the double hull vessel 5. In this preferred embodiment, a trunk structure 53 is added to the internal vessel structure 7 and topside deck plating 13*a* that is removed from the vessel 1. Preferably, the trunk structure 53 is connected to the peripheral edge of the cut out section of topside deck plating 13*a* that was removed. The trunk structure 53 is employed to minimize any loss in the cargo carrying capacity of the vessel. The trunk structure 53 is connected along and extends between the cut line 25*a* around the outer peripheral of the cut out section of topside deck plating 13*a* that was removed and the outer peripheral edge of the opening defined by the topside deck plating 13*b* that was left in place. The trunk structure 53 and raised deck 13*d* define an additional volume of the cargo carrying volume 12. The height of the trunk structure 53 is determined by the desired cargo carrying capacity for the vessel 5. Preferably, the trunk structure 53 is sized to compensate for the height of the new inner hull 6 so that no loss in cargo carrying capacity results. In this way, the cargo carrying capacity of the double hull vessel 5 remains substantially the same as it was when the vessel was a single hull vessel 1.

Figure 7:
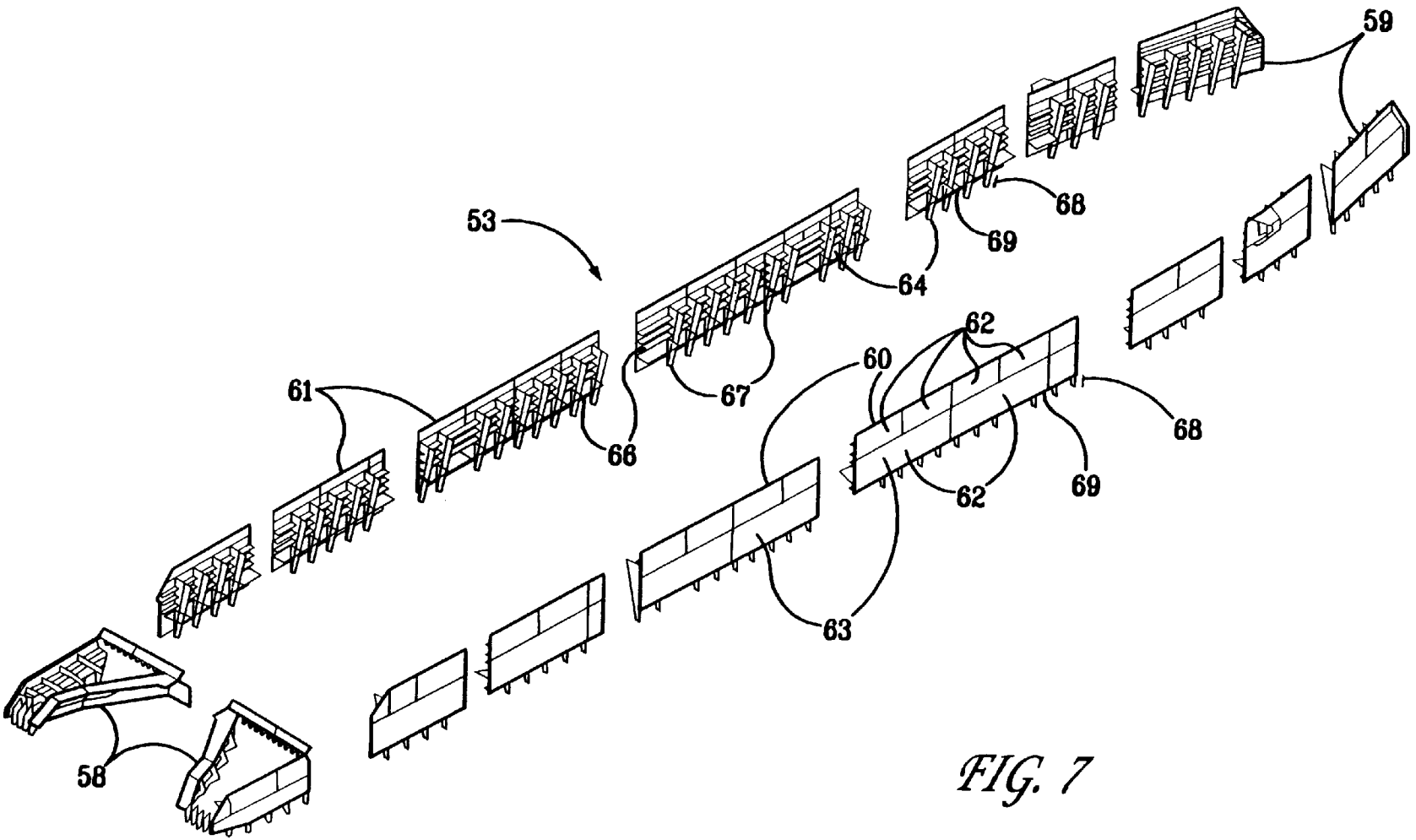
FIG. 7 is a perspective, exploded view of the bulkheads that form the trunk structure.

As shown in FIG. 7, the trunk structure 53 includes a forward trunk bulkhead 58, an after trunk bulkhead 59, a port trunk bulkhead 60, and a starboard trunk bulkhead 61. The trunk bulkheads 58, 59, 60, 61 generally include a plurality of flat metal plate structures 62 having parallel planar surfaces. These individual flat metal plate structures 62 are coupled together to form a plurality of plate assemblies 63. These plate assemblies are coupled together to form each bulkhead 58, 59, 60, 61.

Figure 8:
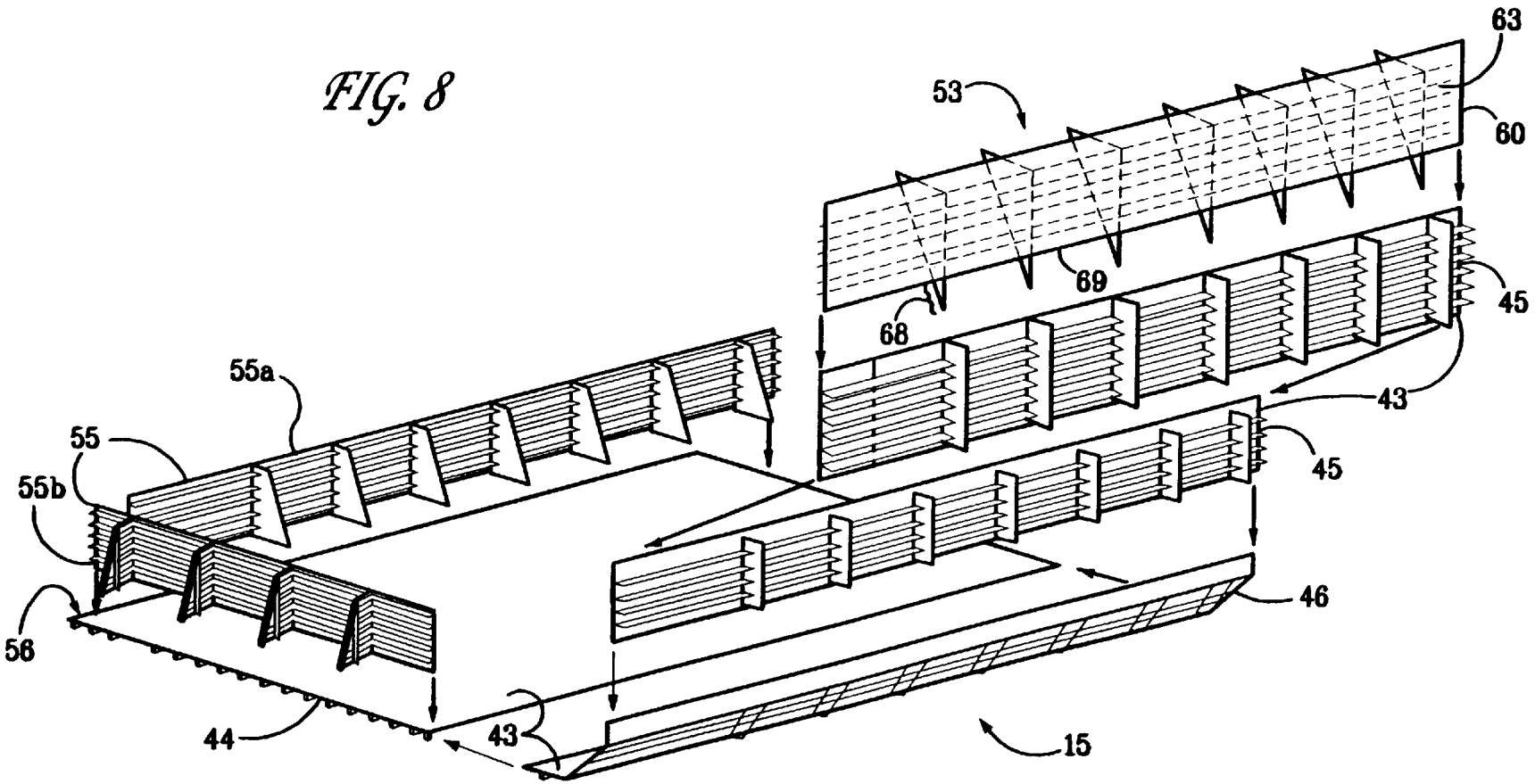
FIG. 8 is an exploded view showing the various plate assemblies.

Trunk framing members 64 are disposed along an inside surface 65 of each trunk bulkhead 58, 59, 60, 61. The trunk framing members include trunk stiffening members 66 and trunk connecting members 67. Preferably the trunk stiffening members 66 comprise longitudinal framing and the bunk connecting members 67 comprise transverse framing. The trunk connecting members 67 are preferably constructed such that at least a portion 68 of each trunk connecting members 67 extends beyond a bottom edge 69 of the trunk structure 53. This provides a stronger connection of the trunk structure 53 to the topside deck plating 13 and new inner hull 6 because the connection extends across the weld line 35*c*, as shown in FIGS. 7 and 8. The bulkheads of the trunk structure 53 are constructed using conventional bulkhead construction techniques.

The trunk structure 53 and raised deck 13*d* may be prefabricated as a single unit, or as a plurality of sections. Preferably, the existing topside deck plating 13*a* that was cut away and removed is used to form the raised deck 13*d* portion of the new trunk structure 53. The existing topside deck plating 13*a* that was cut and removed may be set into an erection building or the like and temporary supports used to elevate the deck plating 13*a* while the trunk structure 53 is connected to the outer peripheral of the deck plating 13*a*. The trunk structure 53 is then installed over the inner hull 6 and topside deck plating 13*b* that was left in place.

Referring back to FIGS. 3 and 4, where a new trunk structure 53 is employed, the inner hull structure 3 also includes new bulkhead portions 55. These new bulkhead portions 55 compensate for the added height resulting from the raised deck 13*d* and trunk structure 53. The new bulkhead portions 55 may be formed separate from and then coupled to the inner hull 6, or preferably the new bulkhead portions 55 are formed integral with the inner hull structure 3.

Preferably, the bulkhead portions 55 are disposed on the interior surface 56 of the inner hull structure 3 as lower bulkhead portions and extend upward to form lower portions of the rebuilt bulkheads 20, 21. This is advantageous because these lower bulkhead portions 55 may be constructed to be more robust than the existing bulkhead 20, 21 structure thereby providing additional strength to support the extra loads due to the trunk structure 53 and the higher level of the raised deck 13*d*. Accordingly, the existing longitudinal and transverse bulkheads 23, 24 are removed with the topside deck plating 13*a* as part of the internal vessel structure 7 so that the stronger, lower portions 55 may be added with the new inner hull structure 3. Alternatively, it is possible to modify the existing bulkhead structure 20, 21 to make it stronger to support the new raised deck and trunk structure 53, or to add the new bulkhead portions at the top of the existing bulkheads to form upper bulkhead portions of the rebuilt bulkheads 20, 21.

Bulkhead portions 55 may comprise one or more longitudinal bulkhead portions 55*a* and/or one or more transverse bulkhead portions 55*b* depending on the design of the existing single hull vessel 1 being rebuilt. The height of that the lower bulkhead portions 55 is preferably substantially the same as the height of the raised deck and trunk structure 53. The bulkhead portions 55 are constructed using conventional techniques for bulkhead designs.

Figure 9:
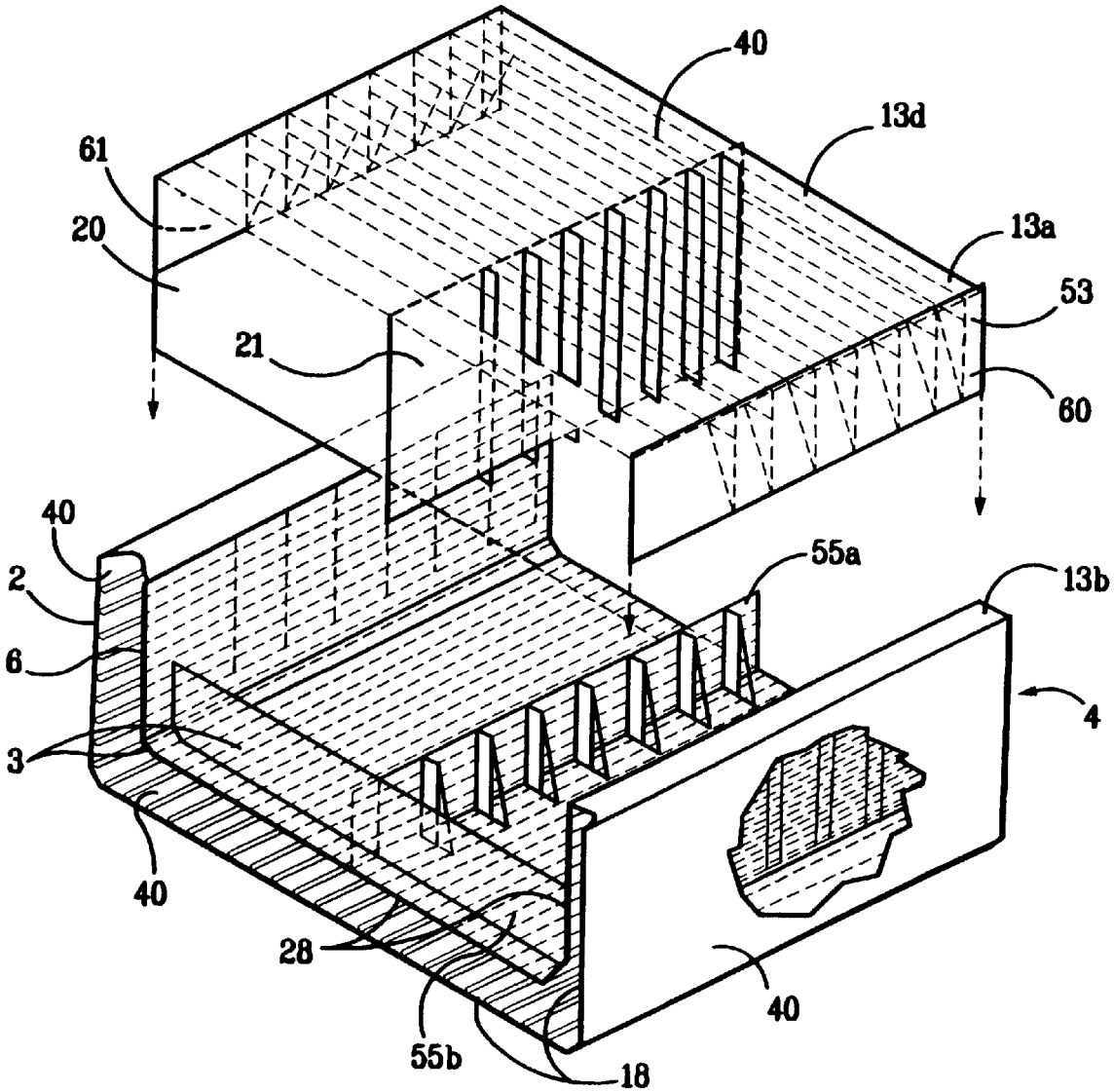
FIG. 9 is an exploded, midship sectional view showing the new double hull, trunk structure and raised deck.

FIG. 8 illustrates an exemplary process of how the various plate assemblies are connected together. The corner 46 plate assembly is coupled to the bottom plate assembly 44. One or more side plate assemblies 45 is coupled to the corner 46 plate assembly, and the trunk side plate assembly 60 is coupled to the upper side plate assembly 45. Lower bulkhead portions 55, including longitudinal bulkhead portions 55*a* and transverse bulkhead portions 55*b*, are coupled to an interior surface 56 of the inner hull 6. FIG. 9 shows a midship sectional of how the trunk structure 53 and raised deck 13*d* fit over the completed double hull 4.

The present invention also provides a method of vessel construction, and particularly, a method of internal double hulling of an existing single hull vessel. The method of the present invention, generally comprises the steps of:

1. Cutting the existing internal structure 7 of the existing single hull vessel 1 proximate the outer bottom 9, outer port side 10, and outer starboard side 11 of the outer hull 2 up to and including the main or topside deck plating 13 along the port 10 and starboard 11 sides and along the stern 16 and bow 17 areas of the vessel 1 (e.g., around the perimeter of the cargo carrying section 12). Preferably the internal structure 7 is cut into one or more sections 7*a* to facilitate the removal of each the sections 7*a* of internal structure 7. Also, the cut lines 25 are preferably made so that the existing hull outer longitudinal framing 23 and outer transverse framing 24 is left in place on the outer bottom 9 and outer sides 10, 11 of the existing outer hull 2.

2. Lifting the cut sections 7*a* out of the shell plating 18 of the existing outer hull 2. Preferably these cut sections 7*a* are lifted from a point of attachment proximate the main deck 13 area and are lifted up and out of the existing hull outer shell 18 or skin. After these cut sections 7*a* of existing internal structure 7 have been removed, they may either be repaired and/or refurbished in place or preferably at a separate repair facility.
3. Prefabricating the new inner hull structure 3. The shape of the new inner hull 6 generally conforms to the shape of the existing outer hull 2 and the inner hull 6 is adapted for connection to the existing external hull structure 40 that was left in place after the cuts.

Preferably, the new inner hull structure 3 is prefabricated in a plurality of modular sections 15 to help facilitate lifting, installation, and fitting of the new inner hull 6 to the existing outer hull 2 structure. Preferably, the new inner hull modules 15 are fabricated from a plurality of flat metal structures 42 or steel plates that are cut and welded to form a plurality of plate or panel assemblies 43. The plurality of panel assemblies 43 are then connected to form bottom plate assemblies 44 and side plate assemblies 45 of the modules 15. The new modules preferably comprise a plurality of flat sheets of metal 42 that are integrated and coupled together to form the new inner hull shell plating 28. Inner transverse 37 and inner longitudinal 36 framing members are coupled to the exterior surface 35 of the flat metal plate assemblies 43 of the inner shell plating 28 and are preferably fabricated to conform to and match up with the existing framing members 22 of the existing outer hull 2. In addition, a plurality of bulkhead portions 55 may be formed on the interior surface 56 extending outward therefrom.

4. Installing and coupling the modular sections 15 of the inner hull structure 3 into place on the existing outer hull structure 40 to form a double hull 4. This step of installing the inner hull structure 3 inside the outer hull 2 includes the additional steps of laying the inner hull structure 3 inside the outer hull 2 and then coupling the inner hull 6 to the outer hull 2. Preferably the new inner hull structure 3 is coupled to the existing outer hull 2 by welding. The inner connecting framing members 33 extending outward from the exterior surface 35 of the inner bottom plating 29 of the new inner hull 6 are laid on the outer framing 22 extending outward from the interior surface 8 of the outer hull 2 and then the connecting framing members are welded together. The inner connecting framing members 33 extending outward from the exterior surface 35 of the inner port side plating 30 and inner starboard side plating 31 of the inner hull 6 are lapped onto the outer connecting sing 22 extending outward from the interior surface 8 of the port and starboard sides of the outer hull 2 and the connecting framing members are welded together.
5. Modifying the existing internal vessel structure 7 and decking 13 of the vessel 1 that was cut and removed to conform to the new double hull 4. This comprises adapting the sections 7*a* that were cut and removed for re-connection with the inner hull 6.

In a preferred embodiment, a trunk structure 53 is added between the cut 25 in the topside deck plating 13*a* that was removed and the topside deck plating 13*b* that was left in place. Preferably, this trunk structure 53 includes a bulkhead that is prefabricated and extends substantially downward from the outer peripheral edge of the main deck plating 13*b* that was cut away and removed. When the internal structure 7 and topside deck plating 13*b* having the trunk structure 53 is re-installed into the inner hull 6, the trunk structure 53 forms a raised bulkhead on the main deck between the cut lines 25. The height of the new bulkhead section of the trunk structure 53 is predetermined based on the desired cargo carrying capacity of the completed double hull vessel 5.

Alternatively, the existing internal vessel structure may be re-installed without a trunk structure 53 such that the topside deck plating 13*a* that was removed and the topside deck plating 13*b* that was left in place are re-connected at the cut line 25.

6. Installing the modified/adapted internal ship structure 7 and the original main deck plating 13*b* that was cut and removed into the inner hull 6 of the double hull 4.
7. Coupling the modified internal ship structure 7 and the original main deck plating 13*b* that was cut and removed to the shell plating 28 of the inner hull 6 of the double hull 4 and the external structure 40 of the original hull 1 that was left in place.
8. Modifying the vessel's mechanical, electrical, cargo, and structural systems as required to allow for operation with the new double hull 4, and for a raised deck in those embodiments having a trunk structure 53.

The following is an example of the practice of the present invention on a barge. Application of the invention employed as much of the existing barge as possible to smoothly integrate it with the entirely new inner hull structure 3 and the new trunk structure 53. A detailed inside measurement was performed to detect changes from the design to "as-built." From these measurements, substantial modular 15 pre-assembly of the inner hull structure 3 was completed before the barge arrived in the yard. When the vessel arrived, the topside deck 13 and internal vessel structure 7 were cut into five large sections 7*a*. These sections 7*a*, with their attached transverse and longitudinal bulkheads 20, 21, were removed and stored separately.

The prefabricated modular sections 15 were laid on top of the existing bottom transverse frames 24 and lapped onto the frames 24 at the side. Forward and aft, where the barge has more shape, the plating and modules 15 were installed in smaller increments. Because most of the original main deck 13 and bulkheads 20, 21 were being raised to create a trunk deck structure 53, new lower portions 55 of the transverse and longitudinal bulkheads 20, 21 were fabricated and fitted. The new bulkhead portions 55 were added on the new inner hull structure 3 and formed the bottom portion of the new extended rebuilt bulkheads thereby providing additional strength at the bottom of the bulkhead to support the extra load due to the higher level of the raised deck 13*d*. While the work was going on inside, the new side walls of the raised trunk 53 were fitted to the original deck 13 and bulkheads 20, 21. Finally, the completed deck and upper bulkhead assembly or trunk structure 53 was installed inside the new inner hull 6 of the double hull 4.

The cargo carrying volume of the original barge was maintained approximately the same by raising a trunk structure 53 from the original main deck 13 and using the existing structure to the maximum extent possible. The resulting rebuilt double hull vessel 5 thus resembles newly built double hull vessels, at a substantial cost savings as compared to the cost of new construction.

The art is well aware of procedures for cutting apart pre-existing vessels and inserting new hull sections and equipment. Essentially similar techniques of cutting and welding may be employed to carry out the invention Similarly, methods of revising the vessel's cargo and ballast piping to allow suitable flow of oil and water into its various tanks, and of its wiring and control systems, are well within the knowledge of those skilled of the art.

According to the present invention, a conventional single hull vessel 1 may be internally rebuilt as a double hull vessel 5 having a double hull 4 extending at least over the length of the cargo carrying section 12 of the vessel. The new inner hull structure 3 spaces the cargo carrying tanks 12 from the outer hull 2 or skin of the vessel, thereby protecting against cargo spillage in the event of penetration of the sides and/or bottom of the outer hull 2 due to collision or grounding damage. The existing outer shell plating 18 of the vessel forms the skin of the outer hull 2 of the double hull 4 and the inner shell plating 28 of the new inner hull 6 forms the skin of the inner hull 6 of the double hull 4.

Preferably, the relative exterior proportions of the vessel prior to and after rebuild are relatively the same. In a first embodiment, the exterior shape and outer hull dimensions of the hull and topside decking remain relatively the same and the cargo carrying capacity is reduced by the addition of the new inner hull structure 3, while in the preferred embodiment, the exterior shape and outer hull dimensions remain relatively the same, but the topside decking is rebuilt with a trunk structure 53 (e.g., the main deck and superstructure of the vessel are modified), which allows the cargo carrying capacity to remain relatively the same.

The present invention provides a double hull vessel from an existing single hull vessel at a fraction of the cost of construction of a new vessel. The cost of the rebuild is estimated to be attractive with respect to the cost of construction of a new double-hulled vessel of comparable capacity. Obviously the economics of internally rebuilding any particular vessel will vary, particularly in dependence on the anticipated economic useful life of the rebuilt vessel.

While the invention has been described with reference to a preferred embodiment, it will be understood by those skilled in the art that various changes may be made and equivalents may be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A double hull vessel comprising:

an outer hull of an existing single hull vessel;

an inner hull internally fitted in spaced apart relationship with said outer hull;

a plurality of connecting members disposed between and connecting said inner hull to said outer hull;

wherein said outer hull and said inner hull form a double hull of a rebuilt double hull vessel and wherein said outer hull of said double hull of said rebuilt double hull vessel maintains the same outer hull shape and outer hull dimensions as said outer hull of said existing single hull vessel, wherein said inner hull is connected to said outer hull using a transversely framed design.

2. The double hull vessel of claim 1 wherein said inner hull extends over at least a cargo carrying section of said double hull vessel.

3. The double hull vessel of claim 1 wherein said double hull vessel is adapted for carrying one or more of a liquid cargo, a granular cargo, and a gaseous cargo.

4. A method of rebuilding an existing single vessel to form an internally rebuilt double hull vessel comprising the steps of:

providing an existing single hull vessel having an outer hull;

cutting an opening in said existing single hull vessel;

removing an existing internal vessel structure through said opening in said existing single hull vessel;

installing a new inner hull through said opening and over said existing outer hull;

connecting said new inner hull to said existing outer hull;

reinstalling said removed existing internal vessel structure through said opening in said existing single hull vessel; and closing said opening in said existing single hull vessel.

5. The method of claim 4 wherein said step of cutting an opening in said existing single hull vessel further comprises cutting an opening in a topside deck plating of said existing single hull vessel.

6. The method of claim 4 wherein said method further comprises the step of forming a double hull of a rebuilt double hull vessel including said outer hull and said inner hull, and maintaining an outer hull shape and outer hull dimensions of said outer hull of said double hull of said rebuilt double hull vessel the same as an outer hull shape and outer hull dimensions of said outer hull of said existing single hull vessel.

7. The method of claim 4 wherein said method further comprises the step of connecting said inner hull to said outer hull using a transversely framed design.

8. The method of claim 4 wherein said step of reinstalling further comprises connecting said removed existing internal vessel structure to said inner hull.

* * * * *